United States Patent [19]

Still

[11] 4,133,398

[45] Jan. 9, 1979

[54] COLLAPSIBLE SPIDER FOR USE IN SUPPORTING CASING DURING UPWARD DRILLING OPERATIONS

[75] Inventor: Norman H. Still, Brea, Calif.

[73] Assignee: Smith International, Inc., Newport Beach, Calif.

[21] Appl. No.: 772,458

[22] Filed: Feb. 28, 1977

[51] Int. Cl.[2] ..... E21B 19/00

[52] U.S. Cl. ..... 175/171; 294/86.24; 294/97

[58] Field of Search ..... 175/171, 53, 85; 294/97, 86.24, 86.25; 214/1P, 2.5

[56] References Cited

U.S. PATENT DOCUMENTS

| | | | |
|---|---|---|---|
| 549,024 | 10/1895 | Ross | 294/97 X |
| 1,282,479 | 10/1918 | Smith | 294/97 |
| 1,502,105 | 7/1924 | Loy | 294/86.24 |
| 2,160,472 | 5/1939 | Cizek | 294/86.24 |
| 3,284,125 | 11/1966 | Blaske, Sr. et al. | 294/97 |
| 3,469,298 | 9/1969 | Pizzagalli | 294/97 X |
| 4,011,907 | 3/1977 | Clay | 166/241 |

*Primary Examiner*—William F. Pate, III

[57] ABSTRACT

During upward drilling operations the casing for the hole is, at times, supported from the drill stem from which the cutterhead is operatively driven. A collapsible spider is placed about the drill stem and supported therefrom, and has extension arms which, during one operating condition, pass underneath the lower end of the casing for providing it with vertical support, and in another operating condition are pivotally folded upwardly so that the casing may be moved vertically past both the spider and its associated drill stem.

8 Claims, 7 Drawing Figures

COLLAPSIBLE SPIDER FOR USE IN SUPPORTING CASING DURING UPWARD DRILLING OPERATIONS

BACKGROUND OF THE INVENTION

When drilling in the earth, the techniques for drilling downwardly, horizontally, and upwardly have much in common. Many differences do exist, however, because of the differences in the problems which are presented to the driller. The present invention relates specifically to drilling upwardly, and more particularly, to apparatus that is used for the specific purpose of casing the upwardly drilled hole.

SUMMARY OF THE INVENTION

According to the present invention a collapsible spider is provided which, in one operating condition, may be used to support a casing section in circumdisposed relationship to a drill stem section, while in another operating condition it will permit a desired vertical movement of the casing section relative to the drill stem section to take place.

More specifically, a circumferential flange which is located at or near the lower end of the drill stem section is used for the purpose of providing vertical support to the collapsible spider. The collapsible spider includes a supporting base which may be placed about the drill stem section and secured thereto, so as to be supported by the aforesaid flange. The collapsible spider also includes at least two arms which are pivotally supported from the supporting base, and which normally extending horizontally outwardly therefrom. The radius span of the arms is sufficient so that in their normal position they will pass underneath the lower end of the casing section, providing it with vertical support.

The extension arms of the collapsible spider may, however, be pivoted upwardly relative to the supporting base. The diameter of the supporting base with arms folded is less than the inner diameter of the casing section. It is therefore possible to move the casing section vertically past the spider, when the spider is in its collapsed condition.

DRAWING SUMMARY

PREFERRED EMBODIMENT

Figure 1:
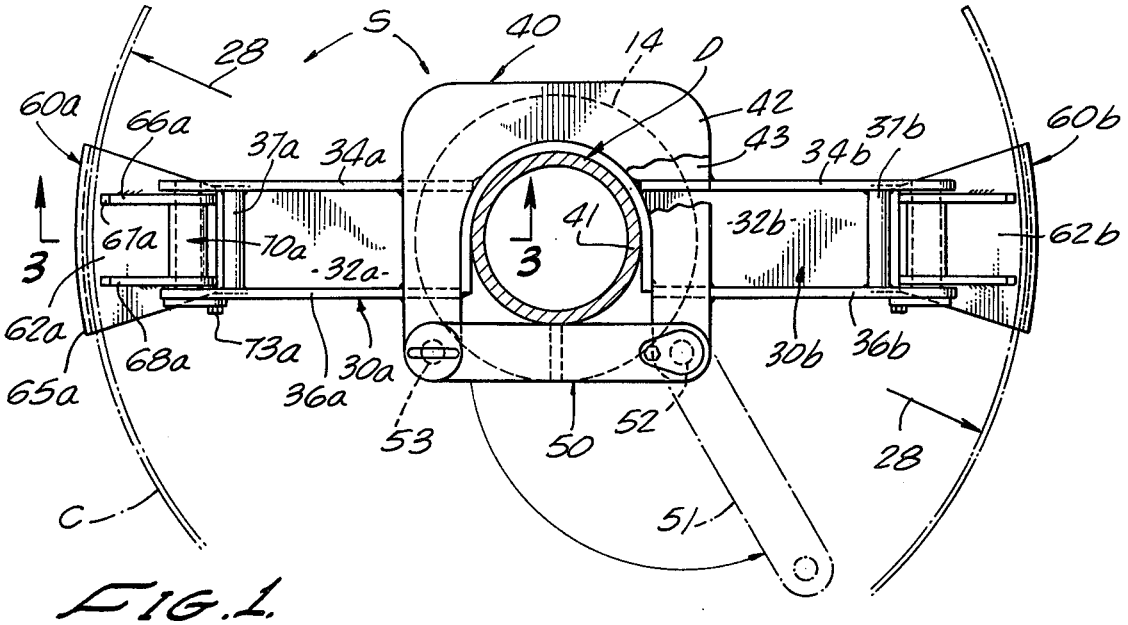
FIG. 1 is a top plan view, partially in cross-section, showing the collapsible spider of the present invention when in use.

Reference is now made to drawing FIGS. 1–7, inclusive, illustrating the presently preferred embodiment of the invention. In general, a drill stem section D has a circumferential flange 14 near its lower end. A collapsible spider S has a supporting base 30–50 which fits about the drill stem D and rests upon the flange 14. Spider S has extending arms 60 which are supported by means of pivot joints 70 from the supporting base 30–50. When the spider S is being used, a casing section C is circumdisposed about the drill stem section D in substantially concentric relationship thereto. In one operating condition (FIG. 7) the lower end 26 of casing section C rests upon the spider arms 60, and in another operating condition (FIG. 6) the spider arms 60 are folded upward so that the casing section C can move vertically past the spider. In other words, in the former condition, the arms 60 may be considered to be aligned with their respective supporting bases; in the latter condition, they may be considered to be pivotally misaligned.

More specifically, while the drill stem section D is not shown in its entirety in any of the views, its upper end 12 carries an upper end flange that is not shown in the present drawings, and its lower end 16 carries a lower end flange that also is not shown. The circumferential flange 14 that is shown in the drawings is located near the lower end of the drill stem section. It has a circumferential upper surface 13 and a circumferential lower surface 15. During other steps of the drilling operation, not specifically described herein, the drill stem section D is vertically supported by means of a hair pin assembly which engages the lower surface 15 of flange 14. The flange 14 of the drill stem section D may, therefore, for convenience, be referred to as the hair pin flange. In accordance with the present invention the collapsible spider S is supported upon the upper surface of the hair pin flange, i.e., the circumferential surface 13.

Figure 6:
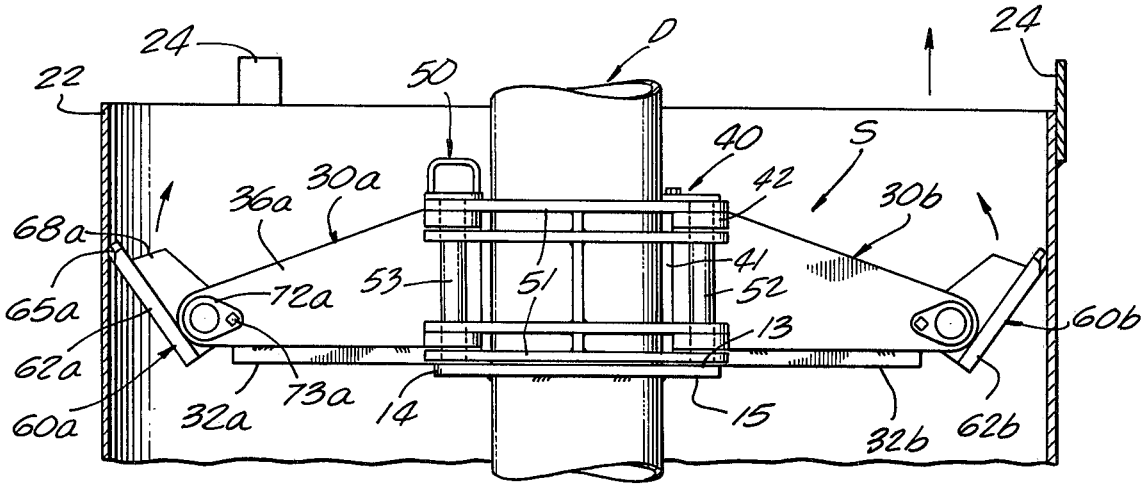
FIG. 6 is an elevation view, partly in cross-section, showing the drill stem, spider, and casing section when the casing section is being moved vertically relative to the spider.
Figure 7:
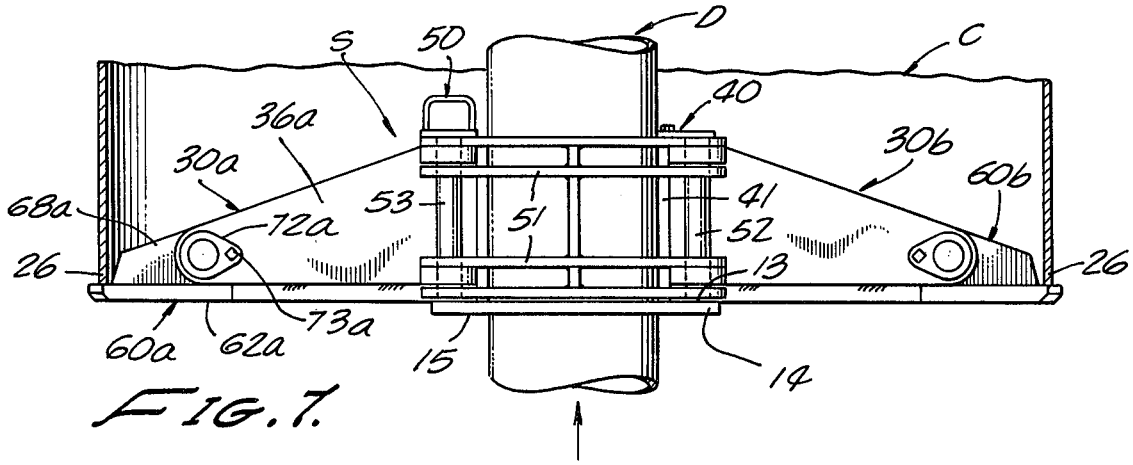
FIG. 7 is a view similar to FIG. 6 but showing the lower end of the casing section resting upon the spider arms.

While the drill stem section D may typically have an outer diameter, not including the flanges, of about eight or nine inches, the casing section C is a cylindrical pipe section having a typical diameter of about 48 or 50 inches. The upper end of the casing section is identified by numeral 22 (FIG. 6) while its lower end is identified by numeral 26 (FIG. 7). Plates 24 (FIG. 6) attached to the upper end of the casing section are used for purpose of welding it to the next casing section that lies above it. The inner diameter of casing section C is, for convenient reference, identified in FIG. 1 by arrows 28.

Figure 2:
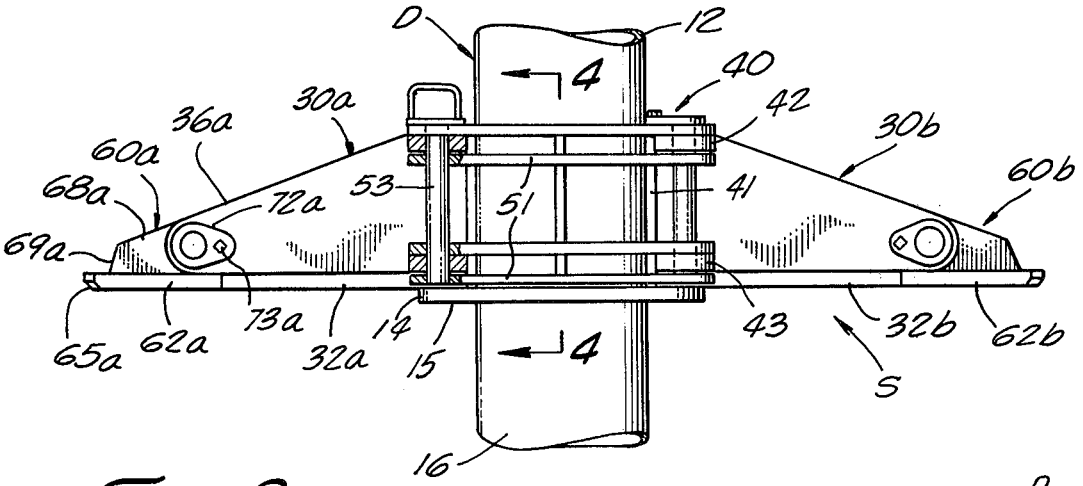
FIG. 2 is an elevation view of the collapsible spider supported on a drill stem section.

In the collapsible spider S the supporting base 30–50 includes a base frame 30, a cage 40, and latch means 50. Base frame 30 is divided into symmetrical left-hand and right-hand parts **30*a*, 30*b*, respectively, between which the cage 40 is interposed (FIG. 2**).

Thus the base frame **30*a* includes a flat metal bottom plate 32*a* to the upper surface of which a parallel pair of vertically disposed brace plates 34*a*, 36*a* are secured (FIG. 1). A bracing pin 37*a*** extending laterally between the brace plates near their outer ends adds to the rigidity of their support.

Figure 3:
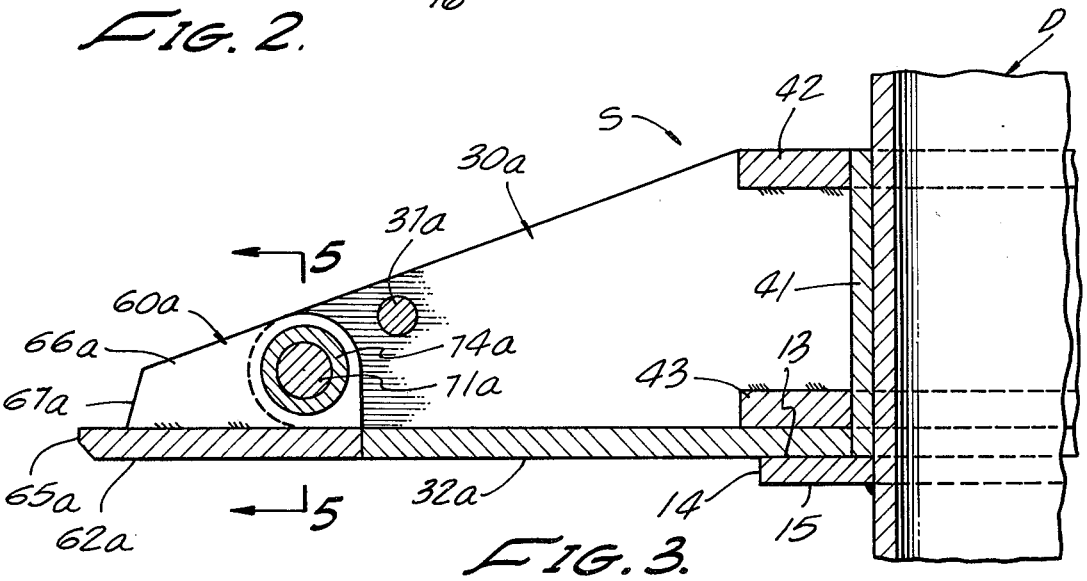
FIG. 3 is a cross-sectional elevational view of the drill stem and spider taken on the line 3—3 of FIG. 1.
Figure 4:
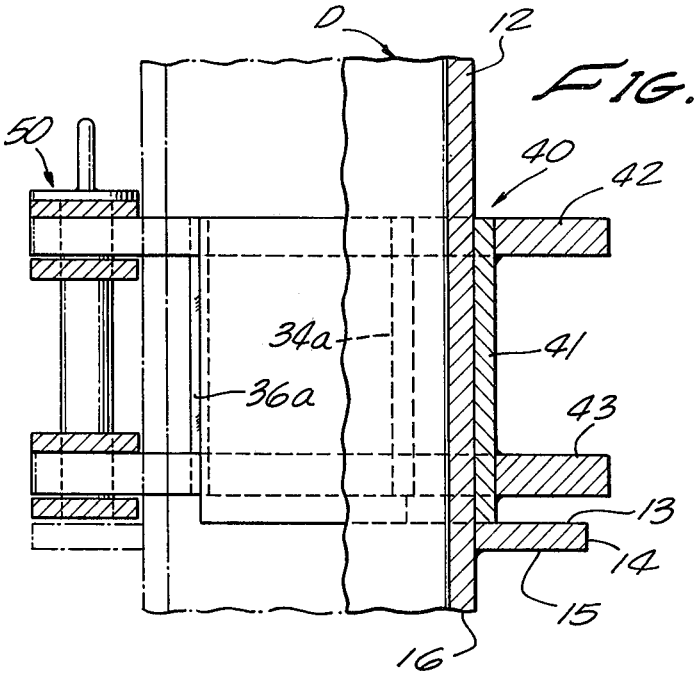
FIG. 4 is a cross-sectional elevational view of the drill stem and spider taken on the line 4—4 of FIG. 2.

The cage 40 includes a U-shaped top plate 42 and a U-shaped bottom plate 43 which are substantially identical to each other and which are spaced vertically apart by a distance which is comparable to the diameter of the drill stem section D. See FIGS. 3 and 4. Another elongated metal plate 41 is bent into a U-shaped band configuration when viewed in a horizontal plane as shown in FIG. 1. The U-band 41 engages and is secured to the interior wall of the U-shaped cut-out in each of the plates 42, 43 (FIGS. 1, 3 and 4). The U-band also extends somewhat below the bottom U-plate 43 so as to engage the interior ends of the flat bottom plates 32*a*, 32*b* (FIG. 3).

The cage parts 41, 42, and 43 are welded to each other and to the bottom plates 32 and brace plates 34, 36 so as to form a solid structure. The radially inward ends of the brace plates 34, 36 are provided with corner cut-outs for receiving the U-plates 42, 43, respectively (FIG. 3). The brace plates 34, 36 taper downward toward their outer ends so that their height above the outer ends of the bottom plates 32 is only about half their height where they adjoin the cage 40.

The cage 40 and its U-band 41, therefore, provide a laterally opening recess in the supporting base for receiving the drill stem D. The latch means 50 includes a latch frame 51 which is pivotally secured to one side of the recess by means of a pivot pin 52, and when the latch frame is closed its other end may be secured to the other side of the recess by means of a removable latch pin 53. The latch frame is pivoted to its open position shown in dotted lines in FIG. 1, whenever the spider is to be placed upon or removed from the drill stem.

The left-hand and right-hand extension or spider arms 60*a*, 60*b*, respectively, are of identical construction. Thus the arm 60*a* includes a flat bottom plate 62*a* to the upper surface of which a parallel pair of vertically extending brace plates 66*a*, 68*a* are secured. See FIGS. 1, 3, and 5. The outer ends of the brace plates do not extend all the way to the end of the bottom plate, but are slanted downward at 67*a*, 69*a* to provide upwardly and outwardly facing shoulder surfaces for the purpose of centering the casing section C relative to the drill stem D.

Figure 5:
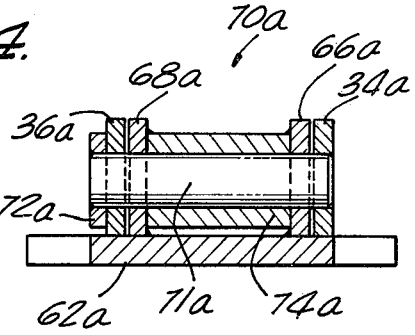
FIG. 5 is a cross-sectional view of a pivot joint of the spider taken on the line 5—5 of FIG. 3.

The pivot joints 70*a*, 70*b* are also of identical construction. The inner ends of brace plates 66*a*, 68*a* of the extension arm 60*a* fit within the outer ends of the brace plates 34*a*, 36*a* of the base frame 30*a* (FIGS. 1 and 5). A pivot pin 71*a* extends through holes in both pairs of brace plates. A bushing-like spacer or pin housing 74*a* may be placed between the brace plates of the extension arm to maintain their lateral separation and provides rigid support. One end of pivot pin 71*a* may be provided with a head 72*a* which is staked or fastened at 73*a* to the brace plate 36*a*. Of course, the pin could be fixed against axial movement by any other means desired.

While the bottom plates 62*a*, 62*b* of the extension arms may be of rectangular configuration, it is in fact preferred that they be essentially pie-shaped as shown. Thus the bottom plate 62*a* has an arcuately curved outer end surface 65*a* which, when supporting the casing C, extends slightly beyond the wall of the casing and supports a significant segment of its circumference.

The pivotal action of the extension arms is provided by their construction and the construction of the pivot joints as shown in FIGS. 3 and 5. FIG. 6 illustrates the pivoting movement. When the arms are pivoted upward, each of the arm bottom plates swings outward and upward, out of contact with the outer end of the bottom plate of the base frame. When the pivoting action is completed, and the arms drop back to their normal horizontal position, the inner end of bottom plate 62*a*, for example, butts against the bottom plate 32*a* in alignment therewith, and the same action takes places on the right-hand side of the spider.

In a broad sense the purpose and manner of use of the present invention is the subject of another separate invention, to be covered in a subsequently filed application for patent. In a more specific sense, however, the collapsible spider of the present invention is intended to be placed between a drill stem section D and a casing section C, and in one operating condition to support the weight load of the casing section directly from the drill stem section, while in another operating condition the arms of the spider are folded upward so that the casing section may be moved vertically relative to the spider and drill stem section.

Still more specifically, the collapsible spider of the present invention is used for the purpose of raising a casing section which is initially located below the level of the corresponding drill stem section, causing the foldable arms of the spider to be folded upward as a direct result of the upward movement of the casing section, and then when the casing section has completed its upward movement, lowering it somewhat downwardly so that it may be supported upon the ends of the spider arms which in the meantime have dropped back as the result of the weight of gravity, into their normally horizontal positions.

ALTERNATE FORMS

While a particular and presently preferred embodiment of the invention has been illustrated in detail, it will be understood that there are other alternate forms of the device which may be utilized to achieve the same purposes with essentially the same degree of effectiveness, and which are encompassed within the scope of the present invention. For example, the supporting base instead of being an elongated structure with a lateral recess near its longitudinal center may instead be an essentially circular structure formed in two halves which are pivotally supported relative to each other. Also, although the spider as presently illustrated has only two extension arms, located at positions which are circumferentially spaced from each other by 180 degrees, it may be equally desirable to utilize three arms spaced at 120 degrees or perhaps four arms spaced at 90 degree intervals. Other modifications which may be made within the scope of the present invention will be readily apparent to those skilled in the art.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. In apparatus for drilling and casing an upwardly extending hole, the combination comprising:

a vertically extending drill stem section having at least one circumferential flange near its lower end;

an elongated supporting base extending horizontally and having a laterally opening recess at its longitudinal center, the drill stem being received within said recess and said supporting base resting upon said drill stem flange;

latch means carried by said supporting base and cooperating with said recess to extend about the drill stem for securing said supporting base thereto;

a pair of extension arms secured to respective ends of said supporting base and normally extending horizontally outwardly therefrom, said arms being selectively pivotal upwardly; and a cylindrical casing section having an inner diameter greater than the length of said supporting base but less than the span of said extension arms, said casing section being disposed substantially concentric to said drill stem section and the lower end thereof normally resting upon said arms.

2. The apparatus claimed in claim 1 wherein said extension arms have outwardly facing shoulders on their upper surface near their outer ends, for locating the casing concentric to the drill stem.

3. Apparatus as claimed in claim 1 wherein said supporting base includes a horizontal bottom plate and a parallel pair of vertically extending brace plates secured to the upper surface of said bottom plate, and which further includes a pivot pin associated with each end of said brace plates and which passes horizontally through both of said brace plates for pivotally supporting the associated extension arm.

4. A collapsible spider, adapted to be supported from a vertically extending drill stem section which has at least one circumferential flange near one end thereof, for selectively supporting a casing section relative to the drill stem section when in circumdisposed relationship thereto, said spider comprising:

a supporting base adapted to be horizontally disposed and having near its center an open recess adapted to fit about a drill stem section so that said support base may seat upon a drill stem flange;

a plurality of extension arms supported upon said supporting base and extendible outwardly therefrom;

pivot means securing said extension arms to said supporting base such that said extension arms may swing pivotally upwardly but may not swing downwardly;

latch means pivotally attached to said supporting base adjacent said recess; and means for releasably securing said latch means adjacent said recess to close the opening therein.

5. A collapsible spider, adapted to be supported from a vertically extending drill stem section which has at least one circumferential flange near its end thereof, for selectively supporting a casing section relative to the drill stem section when in circumdisposed relationship thereto, said spider comprising:

a supporting base adapted to be horizontally disposed and having near its center an open recess adapted to fit about a drill stem so that said supporting base may rest upon a drill stem flange, said base including a bottom plate and a pair of brace plates secured substantially perpendicularly to said bottom plate;

a plurality of extension arms supported from respective ends of said supporting base and normally extending outwardly therefrom; and pivot means securing said extension arms to said supporting base such that said extension arms may swing pivotally upwardly but may not swing downwardly, said pivot including pin means which pass through said brace plates and said arms so as to movably attach said arms to said supporting base.

6. A spider for supporting a casing relative to a drill stem comprising base means having a cage section including recess means open on one side thereof for locating said base means about a drill stem and means for selectively prohibiting removal of said cage section from about a drill stem by closing the opening in said recess means; and a plurality of support means fixed to said cage section and extending radially outwardly therefrom; and a spider arm pivotally mounted upon each of said support means for alignment therewith to support a casing thereon and for misalignment therewith to allow relative movement between the spider and a casing.

7. The spider of claim 6 wherein said support means include means for prohibiting pivotal misalignment of said spider arms in one direction while not inhibiting such pivotal misalignment thereof in the opposition direction.

8. The spider of claim 7 wherein said spider arms include means thereon for locating and supporting a casing in substantially concentric relationship with a drill stem within said recess means.

* * * * *